US008844229B1

(12) United States Patent
Hohmann, Jr.

(10) Patent No.: US 8,844,229 B1
(45) Date of Patent: Sep. 30, 2014

(54) CHANNEL ANCHOR WITH INSULATION HOLDER AND ANCHORING SYSTEM USING THE SAME

(71) Applicant: Mitek Holdings, Inc., Wilmington, DE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 13/801,084

(22) Filed: Mar. 13, 2013

(51) Int. Cl.
*E04B 1/41* (2006.01)
*E04B 1/76* (2006.01)

(52) U.S. Cl.
CPC ..... *E04B 1/7616* (2013.01); *E04B 1/7675* (2013.01); *E04B 1/4185* (2013.01)
USPC ..... 52/383; 52/379; 52/404.2; 52/513; 52/713; 52/715

(58) Field of Classification Search
CPC ..... E04B 1/4178; E04B 1/4185; E04B 2/30
USPC ..... 52/379, 383, 513, 562, 713, 714, 404.2, 52/715
See application file for complete search history.

(56) References Cited

U.S. PATENT DOCUMENTS

| | | | |
|---|---|---|---|
| 819,869 | A | 5/1906 | Dunlap |
| 903,000 | A | 11/1908 | Priest, Jr. |
| 1,170,419 | A | 2/1916 | Coon et al. |
| RE15,979 | E | 1/1925 | Schaefer et al. |
| 1,794,684 | A | 3/1931 | Handel |
| 1,936,223 | A | 11/1933 | Awbrey |
| 2,058,148 | A | 10/1936 | Hard |
| 2,097,821 | A | 11/1937 | Mathers |
| 2,280,647 | A | 4/1942 | Hawes |
| 2,300,181 | A | 10/1942 | Spaight |
| 2,403,566 | A | 7/1946 | Thorp et al. |
| 2,413,772 | A | 1/1947 | Morehouse |

(Continued)

FOREIGN PATENT DOCUMENTS

| | | | |
|---|---|---|---|
| CH | 279209 | 3/1952 | |
| DE | EP0199595 B1 * | 3/1995 | ..... E04B 1/4178 |

(Continued)

OTHER PUBLICATIONS

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

(Continued)

*Primary Examiner* — Adriana Figueroa
(74) *Attorney, Agent, or Firm* — Silber & Fridman

(57) ABSTRACT

A channel anchoring system for cavity walls is disclosed and includes a channel anchor and veneer tie. The anchoring system is used in conjunction with building structures that have a masonry construction veneer anchored to a steel stud frame or a masonry backup wall. The channel anchoring system secures both the veneer and the insulation to the framing or backup wall. The channel anchor includes a pocket compartment for the insulation that provides a non-invasive means for securing the insulation, thereby maintaining the insulation integrity.

20 Claims, 7 Drawing Sheets

(56) References Cited

U.S. PATENT DOCUMENTS 2,605,867 A 8/1952 Goodwin
2,780,936 A * 2/1957 Hillberg ..... 52/710
2,898,758 A 8/1959 Henrickson
2,929,238 A 3/1960 Kaye
2,966,705 A 1/1961 Massey
2,999,571 A 9/1961 Huber
3,030,670 A 4/1962 Bigelow
3,183,628 A 5/1965 Smith
3,254,736 A 6/1966 Gass
3,277,626 A 10/1966 Brynjolfsson et al.
3,300,939 A 1/1967 Brynjolfsson et al.
3,309,828 A 3/1967 Tribble
3,310,926 A 3/1967 Brandreth et al.
3,341,998 A 9/1967 Lucas
3,377,764 A 4/1968 Storch
3,478,480 A 11/1969 Swenson
3,563,131 A 2/1971 Ridley, Sr.
3,568,389 A 3/1971 Gulow
3,640,043 A 2/1972 Querfeld et al.
3,964,226 A 6/1976 Hala et al.
3,964,227 A 6/1976 Hala
4,021,990 A 5/1977 Schwalberg
4,227,359 A 10/1980 Schlenker
4,238,987 A 12/1980 Siebrecht-Reuter
4,305,239 A 12/1981 Geraghty
4,373,314 A * 2/1983 Allan ..... 52/434
4,382,416 A 5/1983 Kellogg-Smith
4,424,745 A 1/1984 Magorian et al.
4,438,611 A 3/1984 Bryant
4,473,984 A 10/1984 Lopez
4,482,368 A 11/1984 Roberts
4,571,909 A 2/1986 Berghuis et al.
4,598,518 A 7/1986 Hohmann
4,606,163 A * 8/1986 Catani ..... 52/434
4,622,796 A 11/1986 Aziz et al.
4,628,657 A 12/1986 Ermer et al.
4,636,125 A 1/1987 Burgard
4,640,848 A 2/1987 Cerdan-Diaz et al.
4,660,342 A 4/1987 Salisbury
4,703,604 A 11/1987 Muller
4,708,551 A 11/1987 Richter et al.
4,738,070 A 4/1988 Abbott et al.
4,764,069 A 8/1988 Reinwall et al.
4,819,401 A 4/1989 Whitney, Jr.
4,827,684 A 5/1989 Allan
4,843,776 A 7/1989 Guignard
4,852,320 A 8/1989 Ballantyne
4,869,038 A 9/1989 Catani
4,869,043 A 9/1989 Hatzinikolas et al.
4,875,319 A 10/1989 Hohmann
4,911,949 A 3/1990 Iwase et al.
4,922,680 A * 5/1990 Kramer et al. ..... 52/713
4,946,632 A 8/1990 Pollina
4,955,172 A 9/1990 Pierson
5,063,722 A 11/1991 Hohmann
5,099,628 A 3/1992 Noland et al.
5,207,043 A 5/1993 McGee et al.
5,307,602 A 5/1994 Lebraut
5,392,581 A 2/1995 Hatzinikolas et al.
5,408,798 A 4/1995 Hohmann
5,440,854 A 8/1995 Hohmann
5,454,200 A 10/1995 Hohmann
5,456,052 A 10/1995 Anderson et al.
5,490,366 A 2/1996 Burns et al.
5,598,673 A 2/1997 Atkins
5,634,310 A 6/1997 Hohmann
5,669,592 A 9/1997 Kearful
5,671,578 A 9/1997 Hohmann
5,673,527 A 10/1997 Coston et al.
5,755,070 A 5/1998 Hohmann
5,816,008 A 10/1998 Hohmann
5,819,486 A 10/1998 Goodings
5,845,455 A 12/1998 Johnson, III
6,000,178 A 12/1999 Goodings
6,125,608 A 10/2000 Charlson
6,209,281 B1 4/2001 Rice
6,279,283 B1 8/2001 Hohmann et al.
6,284,311 B1 9/2001 Gregorovich et al.
6,332,300 B1 12/2001 Wakai
6,351,922 B1 3/2002 Burns et al.
6,367,219 B1 4/2002 Quinlan
6,612,343 B2 9/2003 Camberlin et al.
6,627,128 B1 9/2003 Boyer
6,668,505 B1 12/2003 Hohmann et al.
6,686,301 B2 2/2004 Li et al.
6,735,915 B1 5/2004 Johnson, III
6,739,105 B2 5/2004 Fleming
6,789,365 B1 9/2004 Hohmann et al.
6,817,147 B1 11/2004 MacDonald
6,827,969 B1 12/2004 Skoog et al.
6,837,013 B2 1/2005 Foderberg et al.
6,851,239 B1 2/2005 Hohmann et al.
6,925,768 B2 8/2005 Hohmann et al.
6,941,717 B2 * 9/2005 Hohmann et al. ..... 52/506.01
6,968,659 B2 11/2005 Boyer
7,007,433 B2 3/2006 Boyer
7,017,318 B1 3/2006 Hohmann et al.
7,043,884 B2 5/2006 Moreno
7,059,577 B1 6/2006 Burgett
D527,834 S 9/2006 Thimons et al.
7,147,419 B2 12/2006 Balbo Di Vinadio
7,152,382 B2 12/2006 Johnson, III
7,171,788 B2 2/2007 Bronner
7,178,299 B2 2/2007 Hyde et al.
D538,948 S 3/2007 Thimons et al.
7,225,590 B1 6/2007 diGirolamo et al.
7,325,366 B1 2/2008 Hohmann, Jr. et al.
7,334,374 B2 2/2008 Schmid
7,374,825 B2 5/2008 Hazel et al.
7,415,803 B2 8/2008 Bronner
7,469,511 B2 12/2008 Wobber
7,481,032 B2 1/2009 Tarr
7,552,566 B2 6/2009 Hyde et al.
7,562,506 B2 7/2009 Hohmann, Jr.
7,587,874 B2 9/2009 Hohmann, Jr.
7,735,292 B2 6/2010 Massie
7,748,181 B1 7/2010 Guinn
7,788,869 B2 9/2010 Voegele, Jr.
D626,817 S * 11/2010 Donowho et al. ..... D8/356
7,845,137 B2 12/2010 Hohmann, Jr.
8,037,653 B2 10/2011 Hohmann, Jr.
8,051,619 B2 11/2011 Hohmann, Jr.
8,096,090 B1 1/2012 Hohmann, Jr. et al.
8,109,706 B2 2/2012 Richards
8,122,663 B1 2/2012 Hohmann, Jr. et al.
8,201,374 B2 6/2012 Hohmann, Jr.
8,209,934 B2 7/2012 Pettingale
8,215,083 B2 7/2012 Toas et al.
8,291,672 B2 10/2012 Hohmann, Jr. et al.
8,347,581 B2 1/2013 Doerr et al.
8,375,667 B2 2/2013 Hohmann, Jr.
8,418,422 B2 4/2013 Johnson, III
8,511,041 B2 8/2013 Fransen
8,516,763 B2 8/2013 Hohmann, Jr.
8,516,768 B2 8/2013 Johnson, III
8,544,228 B2 10/2013 Bronner
8,555,587 B2 10/2013 Hohmann, Jr.
8,555,596 B2 10/2013 Hohmann, Jr.
8,596,010 B2 12/2013 Hohmann, Jr.
8,613,175 B2 12/2013 Hohmann, Jr.
8,667,757 B1 3/2014 Hohmann, Jr.
2001/0054270 A1 12/2001 Rice
2002/0100239 A1 8/2002 Lopez
2003/0121226 A1 7/2003 Bolduc
2003/0217521 A1 11/2003 Richardson et al.
2004/0216408 A1 11/2004 Hohmann, Jr.
2004/0216413 A1 11/2004 Hohmann et al.
2004/0216416 A1 11/2004 Hohmann et al.
2004/0231270 A1 * 11/2004 Collins et al. ..... 52/506.01
2005/0279043 A1 12/2005 Bronner
2006/0198717 A1 9/2006 Fuest
2006/0242921 A1 11/2006 Massie
2006/0251916 A1 11/2006 Arikawa et al.
2008/0092472 A1 4/2008 Doerr et al.

(56) References Cited

U.S. PATENT DOCUMENTS

| | | | |
|---|---|---|---|
| 2008/0141605 | A1 | 6/2008 | Hohmann |
| 2008/0222992 | A1 | 9/2008 | Hikai et al. |
| 2009/0133351 | A1 | 5/2009 | Wobber |
| 2009/0133357 | A1 | 5/2009 | Richards |
| 2010/0037552 | A1 | 2/2010 | Bronner |
| 2010/0101175 | A1 | 4/2010 | Hohmann |
| 2010/0192495 | A1 | 8/2010 | Huff et al. |
| 2010/0257803 | A1 | 10/2010 | Hohmann, Jr. |
| 2011/0023748 | A1 | 2/2011 | Wagh et al. |
| 2011/0041442 | A1 | 2/2011 | Bui |
| 2011/0047919 | A1 | 3/2011 | Hohmann, Jr. |
| 2011/0061333 | A1 | 3/2011 | Bronner |
| 2011/0083389 | A1 | 4/2011 | Bui |
| 2011/0146195 | A1 | 6/2011 | Hohmann, Jr. |
| 2011/0173902 | A1 | 7/2011 | Hohmann et al. |
| 2011/0277397 | A1 | 11/2011 | Hohmann, Jr. |
| 2012/0186183 | A1 | 7/2012 | Johnson, III |
| 2013/0008121 | A1 | 1/2013 | Dalen |
| 2013/0074435 | A1 | 3/2013 | Hohmann, Jr. |
| 2013/0232893 | A1 | 9/2013 | Hohmann, Jr. |
| 2013/0232909 | A1 | 9/2013 | Curtis et al. |
| 2013/0247482 | A1 | 9/2013 | Hohmann, Jr. |
| 2013/0247483 | A1 | 9/2013 | Hohmann, Jr. |
| 2013/0247484 | A1 | 9/2013 | Hohmann, Jr. |
| 2013/0247498 | A1 | 9/2013 | Hohmann, Jr. |
| 2013/0340378 | A1 | 12/2013 | Hohmann, Jr. |
| 2014/0000211 | A1 | 1/2014 | Hohmann, Jr. |

FOREIGN PATENT DOCUMENTS

| | | | | | |
|---|---|---|---|---|---|
| DE | GB2459936 | B | * | 3/2013 | ..... E04B 2/30 |
| GB | 1575501 | A | * | 9/1980 | ..... E04B 1/4178 |
| GB | 2069024 | A | | 8/1981 | |
| GB | 2246149 | A | * | 1/1992 | ..... E04B 2/30 |
| GB | 2265164 | A | * | 9/1993 | ..... E04B 2/30 |

OTHER PUBLICATIONS

Building Envelope Requirements for Commercial and High Rise Residential Buildings, 780 CMR sec. 1304.0 et seq. of Chapter 13, Jan. 1, 2001, 19 pages, Boston, Massachusetts, United States.

Building Code Requirements for Masonry Structures, TMS 402-11/ACI 530-11/ASCE 5-11, Chapter 6, 12 pages.

ASTM Standard Specification A951/A951M-11, Table 1, Standard Specification for Steel Wire for Masonry Joint Reinforcement, Nov. 14, 2011, 6 pages, West Conshohocken, Pennsylvania, United States.

State Board of Building Regulations and Standards, Building Envelope Requirements, 780 CMR sec. 1304.0 et seq., 7th Edition, Aug. 22, 2008, 11 pages, Boston, MA, United States.

Hohmann & Barnard, Product Catalog, 44 pgs (2003).

Hohmann & Barnard, Inc.; Product Catalog, 2009, 52 pages, Hauppauge, New York, United States.

Hohmann & Barnard, Inc.; Product Catalog, 2013, 52 pages, Hauppauge, New York, United States.

Kossecka, Ph.D, et al., Effect of Insulation and Mass Distribution in Exterior Walls on Dynamic Thermal Performance of Whole Buildings, Thermal Envelopes VII/Building Systems—Principles p. 721-731, 1998, 11 pages.

* cited by examiner

CHANNEL ANCHOR WITH INSULATION HOLDER AND ANCHORING SYSTEM USING THE SAME

BACKGROUND OF THE INVENTION

1. Field of the Invention

This invention relates to an improved anchoring and insulation arrangement for use in conjunction with building structures having a masonry construction veneer anchored to steel stud framing or a masonry backup wall. More particularly, the invention relates to a channel anchoring system that secures both the veneer and the insulation to the framing or backup wall without compromising the insulation. The invention is applicable to seismic-resistant structures and to structures requiring insulation.

2. Description of the Prior Art

The move toward more energy-efficient insulated veneer wall structures has led to the need to create a highly-insulated building envelope, which separates the interior environment and the exterior environment of a cavity wall structure. The building envelope is designed to control temperature changes, while maintaining structural integrity. Thermal insulation is used within the building envelope to maintain temperature and therefore restrict the formation of condensation within the cavity. High R-value thermal insulation that is secured to the backup wall or framing is essential to maintaining an energy-efficient building structure. The present invention provides a non-invasive compartment for insulation installation, while simultaneously providing a fast track anchoring channel to interconnect with a veneer tie for embedment in the mortar joints of the masonry veneer.

The present anchoring system provides a secure insulation compartment for rigid, batt, board, spray-on and, in particular, Roxul® insulation. Roxul® insulation is a common choice of insulation in commercial construction. Roxul® is a rock-based mineral fiber insulation comprised of basalt rock and recycled slag which are melted together and spun into fibers and complies with the greater insulation requirements imposed by government standards. It is commonly referred to as stone wool. Roxul® products are corrosion resistant, moisture and mold resistant, fire resistant, energy efficient, and minimize thermal bridging. The structural nature of the Roxul® insulation combined with the anchor insulation compartment of this invention, provide a secure insulation attachment to the backup wall or framing.

In the past, anchoring systems have taken a variety of configurations. Where the applications included masonry backup walls, wall anchors were commonly incorporated into ladder—or truss-type reinforcements and provided wire-to-wire connections with box-ties or pintle-receiving designs on the veneer side. In the late 1980's, surface-mounted wall anchors were developed by Hohmann & Barnard, Inc., now a MiTek-Berkshire Hathaway Company, and patented under U.S. Pat. No. 4,598,518. The invention was commercialized under trademarks DW-10®, DW-10-X®, and DW-10-HS®. These widely accepted building specialty products were designed primarily for dry-wall construction, but were also used with masonry backup walls. For seismic applications, it was common practice to use these wall anchors as part of the DW-10® Seismiclip® interlock system which added a Byna-Tie® wire formative, a Seismiclip® snap-in device—described in U.S. Pat. No. 4,875,319 ('319), and a continuous wire reinforcement.

In an insulated dry wall application, the surface-mounted wall anchor of the above-described system has pronged legs that pierce the insulation and the wallboard and rest against the metal stud to provide mechanical stability in a four-point landing arrangement. The vertical slot of the wall anchor enables the mason to have the wire tie adjustably positioned along a pathway of up to 3.625-inch (max.). The interlock system served well and received high scores in testing and engineering evaluations which examined effects of various forces, particularly lateral forces, upon brick veneer masonry construction. However, under certain conditions, the system did not sufficiently maintain the integrity of the insulation. Also, upon the promulgation of more rigorous specifications by which tension and compression characteristics were raised, a different structure—such as one of those described in detail below—became necessary.

The engineering evaluations further described the advantages of having a continuous wire embedded in the mortar joint of anchored veneer wythes. The seismic aspects of these investigations were reported in the inventor's '319 patent. Besides earthquake protection, the failure of several high-rise buildings to withstand wind and other lateral forces resulted in the incorporation of a continuous wire reinforcement requirement in the Uniform Building Code provisions. The use of a continuous wire in masonry veneer walls has also been found to provide protection against problems arising from thermal expansion and contraction and to improve the uniformity of the distribution of lateral forces in the structure.

Shortly after the introduction of the pronged wall anchor, a seismic veneer anchor, which incorporated an L-shaped backplate, was introduced. This was formed from either 12- or 14-gauge sheetmetal and provided horizontally disposed openings in the arms thereof for pintle legs of the veneer anchor. In general, the pintle-receiving sheetmetal version of the Seismiclip interlock system served well, but in addition to the insulation integrity problem, installations were hampered by mortar buildup interfering with pintle leg insertion.

There have been significant shifts in public sector building specifications, such as the Energy Code Requirement, Boston, Mass. (see Chapter 13 of 780 CMR, Seventh Edition). This Code sets forth insulation R-values well in excess of prior editions and evokes an engineering response opting for thicker insulation and correspondingly larger cavities. Here, the emphasis is upon creating a building envelope that is designed and constructed with a continuous air barrier to control air leakage into or out of conditioned space adjacent the inner wythe, which have resulted in architects and architectural engineers requiring larger and larger cavities in the exterior cavity walls of public buildings. These requirements are imposed without corresponding decreases in wind shear and seismic resistance levels or increases in mortar bed joint height. Thus, wall anchors are needed to occupy the same ⅜-inch high space in the inner wythe and tie down a veneer facing material of an outer wythe at a span of two or more times that which had previously been experienced.

As insulation became thicker, the tearing of insulation during installation of the pronged DW-10X® wall anchor, see infra, became more prevalent. This occurred as the installer would fully insert one side of the wall anchor before seating the other side. The tearing would occur at two times, namely, during the arcuate path of the insertion of the second leg and separately upon installation of the attaching hardware. The gapping caused in the insulation permitted air and moisture to infiltrate through the insulation along the pathway formed by the tear. While the gapping was largely resolved by placing a self-sealing, dual-barrier polymeric membrane at the site of the legs and the mounting hardware, with increasing thickness in insulation, this patchwork became less desirable.

As concerns for insulation integrity grow, the ability to install high R-value thermal insulation, without breaching the insulation with a fastener or anchor, becomes an essential part of the construction process. The present invention provides a response by offering a pocket component formed by the anchors for insulation, which secures the insulation to the backup wall or framing without piercing the insulation or degrading the insulative properties.

In the course of preparing this Application, several patents, became known to the inventors hereof and are acknowledged hereby:

| Pat. No. | Inventor | Issue Date |
|---|---|---|
| 4,703,604 | Muller | Nov. 3, 1987 |
| 4,869,038 | Catani | Sep. 26, 1989 |
| 5,063,722 | Hohmann | Nov. 12, 1991 |
| 5,671,578 | Hohmann | Sep. 20, 1997 |
| 7,059,577 | Burgett | Jun. 13, 2006 |
| 7,481,032 | Tarr | Jan. 27, 2009 |
| 7,562,506 | Hohmann, Jr. | Jul. 21, 2009 |
| 8,122,663 | Hohmann, Jr., et al. | Feb. 28, 2012 |
| 8,215,083 | Toas et al. | Jul. 10, 2012 |

U.S. Pat. No. 4,703,604—Muller—Issued Nov. 3, 1987 Discloses a method of building a structure formed from a masonry wall with an outer face carrying frame members, insulation and sheathing. The insulation is fitted between the frame members and against the brace panel with the anchors fixed to the insulation and framework with the stems of the anchor projecting away from the panel and past the insulation.

U.S. Pat. No. 4,869,038—Catani—Issued Sep. 26, 1989 Discloses a veneer wall anchoring system that interconnects a backup wall of block construction with a brick veneer wall. A wall of rigid insulation is placed against an outer face of the backup wall with the plates extending through the insulation. The plate includes a spring clip fastener which engages the insulation wall.

U.S. Pat. No. 5,063,722—Hohmann—Issued Nov. 12, 1991 Discloses a gripstay channel veneer anchor assembly that engages an insulation layer and the inner wythe. A clip securement projects through the channel, pierces the insulation and engages the support member.

U.S. Pat. No. 5,671,578—Hohmann—Issued Sep. 30, 1997 Discloses a surface-mounted seismic construction system. The system includes a wire formative anchor and box tie. The anchor includes a seismic clip and reinforcement wire and the anchor eye portions are oriented to secure the insulation panels which are protected by insulation shields U.S. Pat. No. 7,059,577—Burnett—Issued Jun. 13, 2006 Discloses an insulated concrete wall system. The system includes insulation panels which are secured by t-shaped wall studs. The wall studs are anchored within the concrete.

U.S. Pat. No. 7,481,032—Tarr—Issued Jan. 27, 2009 Discloses a stud system for supporting spray insulation to a concrete structure. The stud includes a laterally extending web to promote adherence of the insulation.

U.S. Pat. No. 7,562,506—Hohmann, Jr.—Issued Jul. 21, 2009 Discloses a notched, surface-mounted wall anchor and anchoring system. The folded sheetmetal anchor includes a notch that, upon surface-mounting, form small wells in the portion of the notch extending into the insulation to entrain water vapor, condensate and water to prevent entry into the wallboard.

U.S. Pat. No. 8,122,663—Hohmann, Jr. et al.—Issued Feb. 28, 2012 Discloses an anchor and reinforcement device for a cavity wall. The device interlocks with a veneer anchor and veneer reinforcements. The system is composed of wire formatives. The wall anchor and reinforcement devices are compressively reduced in height to span insulation mounted on the exterior of the backup wall.

U.S. Pat. No. 8,215,083—Toas et al. —Issued Jul. 10, 2012 Discloses a unitary building exterior envelope product that includes a mineral fiber insulation board. The product is mounted to exterior wall framing members.

None of the prior art listed above provide a channel anchoring system that secures both the veneer and the insulation to the framing or backup wall without impacting the insulation and its insulative properties. As will become clear in reviewing the disclosure which follows, the cavity wall structures benefit from the recent developments described herein that lead to solving the problems of maintaining thermal insulation within the cavity wall. The wall anchor assembly provides a novel pocket compartment for securing the insulation without the use of fasteners that perforate the insulation. The prior art does not provide the present novel cavity wall construction system as described herein below.

SUMMARY

In general terms, an embodiment of the invention disclosed hereby is a channel anchoring system for use in a cavity wall having a masonry veneer and an inner wythe or backup wall of stud framing or masonry units. The wall anchor and veneer tie secures the veneer and the insulation to the backup wall without compromising the insulation integrity. The veneer ties are wire formatives configured for insertion within the wall anchor channels and the bed joints of the outer wythe. The veneer ties are optionally compressed forming a low profile construct and swaged for interconnection with a reinforcement wire to form a seismic construct.

The channel anchor and anchoring system secures insulation in a pocket within a compartment formed by the consecutive channel anchors. The channel anchor includes a back plate, which is affixed to the backup wall by a fastener, a front plate, which includes elongated slots for interconnection with a veneer tie, a central plate, which interconnects the front and back plates and a compartment flange. The central plate contains a first and a second face.

A novel insulation compartment is formed from the compartment flange, the central plate first face and the central plate second face of adjacent channel anchors. The insulation compartment is configured to form a tight fitting pocket for the securement of the insulation therewithin. The insulation is secured within the compartment without any ripping or tearing of the insulation, thereby maintaining the insulation integrity. The insulation for use with the anchoring system is rigid insulation, board insulation, spray-on insulation, and the like. Rock-based mineral fiber insulation or Roxul® is specifically included in the embodiments.

The channel anchoring system includes a wire formative veneer tie with the interconnecting portion of the veneer tie encased within a buckle for adjustable mounting within the channel anchor elongated slots. The veneer tie insertion portion is secured within the bed joint of the outer wythe. A veneer tie having a swaged side leg with an optional reinforcement wire set therewithin is for use with a seismic system.

It is an object of the present invention to provide new and novel anchoring systems for building structures, which systems secure insulation.

It is another object of the present invention to provide a new and novel high-strength channel anchoring system which provides a compartment to secure insulation therewithin.

It is yet another object of the present invention to provide an anchoring system for a wall having a masonry construction veneer anchored to steel stud framing or a masonry backup wall.

It is still yet another object of the present invention to provide an anchoring system which is constructed to secure both the veneer and the insulation to the framing or backup wall.

It is a feature of the present invention that the channel anchor hereof provides a securement compartment that houses a portion of the Roxul® insulation within the anchor, without tearing or puncturing the insulation.

It is another feature of the present invention that the wall anchor is utilizable with a veneer tie that is secured within the bed joints of the veneer.

It is another feature of the present invention that the anchoring system is for use with a seismic or non-seismic structure.

Other objects and features of the invention will become apparent upon review of the drawings and the detailed description which follows.

BRIEF DESCRIPTION OF THE DRAWINGS

In the following drawings, the same parts in the various views are afforded the same reference designators.

DETAILED DESCRIPTION

Figure 1:
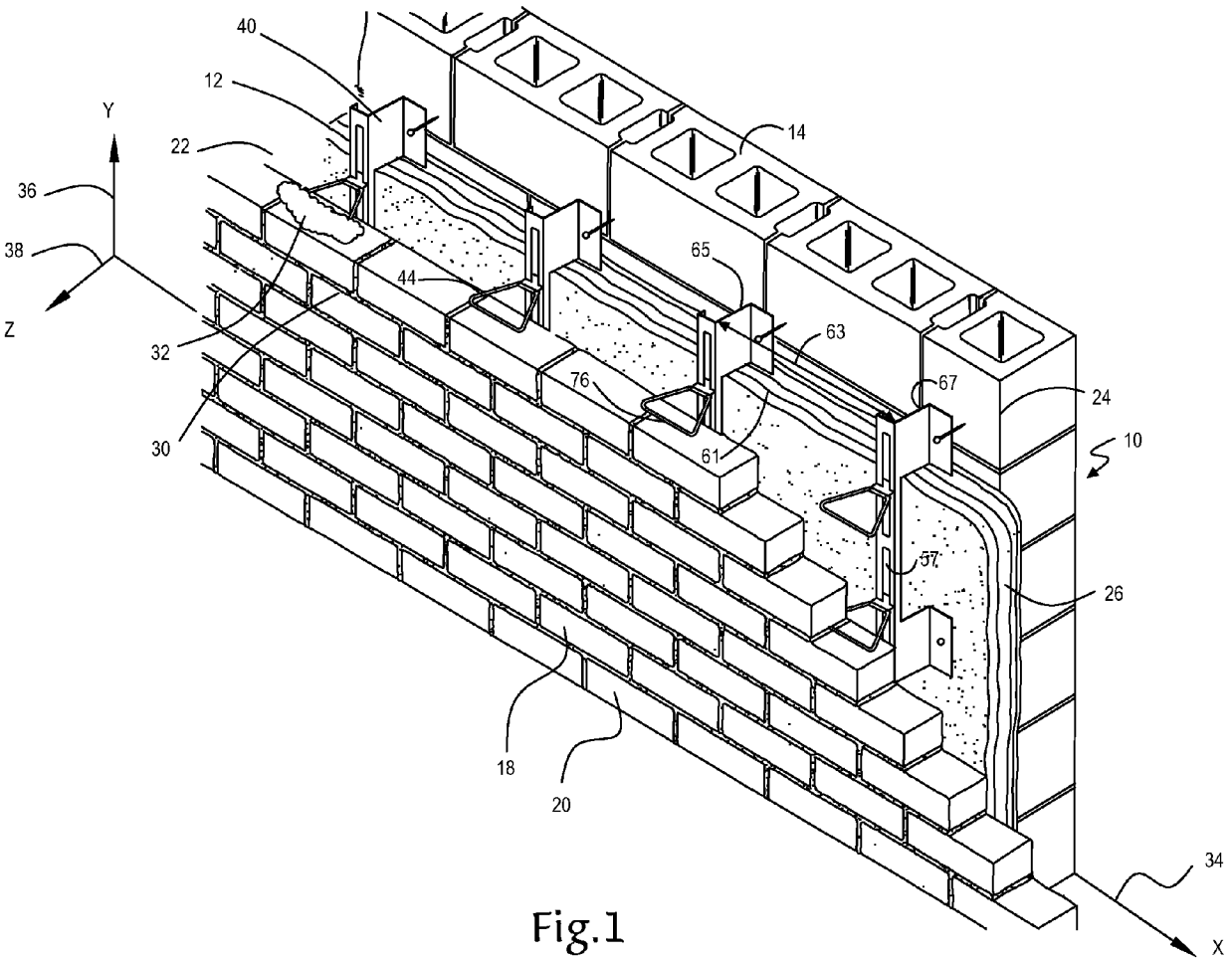
FIG. 1 is a perspective view of the first embodiment of this invention with an anchoring system having a channel anchor and veneer tie inserted therein, as applied to a cavity wall with a backup wall of masonry construction with insulation disposed on the cavity-side thereof and within the channel anchor compartments and a veneer of brick.

Before entering into the Detailed Description, several terms which will be revisited later are defined. These terms are relevant to discussions of innovations introduced by the improvements of this disclosure that overcome the deficits of the prior art devices.

In the embodiments described hereinbelow, the inner wythe is provided with insulation. In both the dry wall stud framing construction inner wythe and in the masonry block inner wythe, the insulation is applied to the outer surface thereof. Recently, building codes have required that after the anchoring system is installed and, prior to the inner wythe being closed up, that an inspection be made for insulation integrity to ensure that the insulation prevents infiltration of air and moisture. The term as used herein is defined in the same sense as the building code in that, "insulation integrity" means that, after the installation of the anchoring system, there is no change or interference with the insulative properties and concomitantly that there is substantially no change in the air and moisture infiltration characteristics.

Anchoring systems for cavity walls are used to secure veneer facings to buildings and overcome seismic and other forces, i.e. wind shear, etc, while ensuring insulation integrity. In the past, some systems have experienced insulation tearing which results in the loss of insulation integrity. In the present invention, insulation integrity is preserved because the insulation is secured in a non-invasive manner, within pockets without causing any perforations in the insulation.

In addition to that which occurs at the facing wythe, attention is further drawn to the construction at the exterior surface of the inner or backup wythe. Here there are two concerns, namely (1) maximizing the strength and ease of the securement of the wall anchor to the inner wythe; and, (2) as previously discussed, maintaining the integrity of the insulation. The first concern is addressed using appropriate fasteners such as self-drilling fasteners for mounting to metal, drywall studs or directly into the masonry. The latter concern is addressed through the use of the novel insulation pocket which secures the insulation to the inner wythe without the use of any invasive fasteners. In the prior art, the metal anchors and fasteners pierced the insulation causing a loss of insulative integrity.

Referring now to FIGS. 1 through 6, the first embodiment shows a channel anchoring system for use with a masonry inner wythe or backup wall. This anchoring system, discussed in detail hereinbelow, has a channel anchor, an interengaging veneer tie and attachment hardware. For the first embodiment, a cavity wall having an insulative layer of 4.0 inches (approx.) and a total span of 4.75 inches (approx.) is chosen as exemplary.

The anchoring system for cavity walls is referred to generally by the numeral 10. A cavity wall structure 12 is shown having a masonry inner wythe or masonry backup 14 and an outer wythe or facing 18 of brick 20 construction. Inner wythes constructed of wood or steel stud framing (not shown) are also applicable. Between the inner wythe 14 and the outer wythe 18, a cavity 22 is formed. The cavity 22 has attached to the exterior surface 24 of the inner wythe 14 insulation 26. The insulation 26 shown is rigid insulation commonly known as Roxul® insulation which is rock-based mineral fiber insulation, but is applicable to other forms including board insulation, rigid insulation and spray-on insulation. Optionally, an air/vapor barrier (not shown) is included between the insulation 26 and the exterior surface 24 of the inner wythe 14.

Successive bed joints 30 and 32 are substantially planar and horizontally disposed and, in accord with current building standards, are 0.375-inch (approx.) in height. Selective ones of bed joints 30 and 32, which are formed between courses of bricks 20, are constructed to receive therewithin the insertion portion of the veneer anchor. Being mounted on the inner wythe 14, the channel anchor or wall anchor 40 is supported thereby and, as described in greater detail herein below, is configured to secure insulation 26 and the outer wythe 18 to the inner wythe 14.

For purposes of discussion, the cavity surface 24 of the inner wythe 14 contains a horizontal line or x-axis 34 and intersecting vertical line or y-axis 36. A horizontal line or z-axis 38, normal to the xy-plane, passes through the coordinate origin formed by the intersecting x- and y-axes. A wall anchor 40, while shown as a unitary structure in FIG. 1, may be manufactured as an assemblage of several wall anchors 40 (see FIG. 6).

Figure 2:
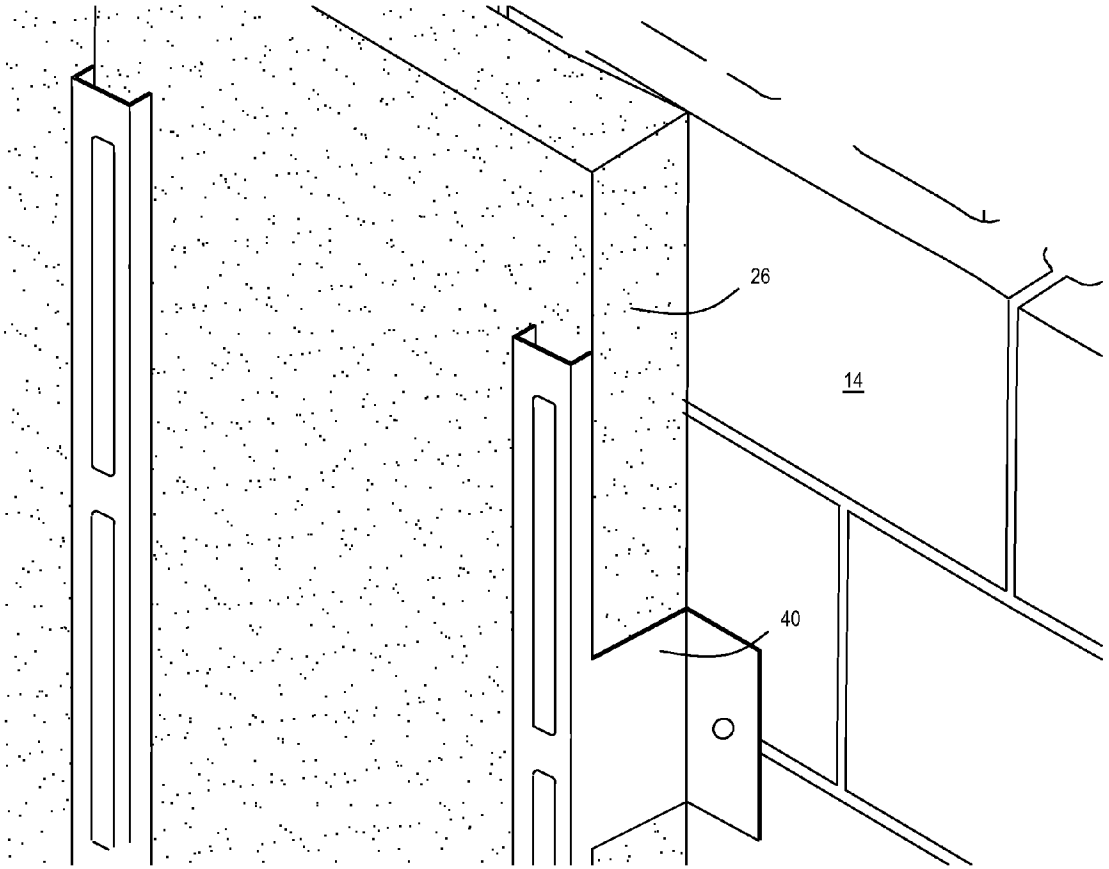
FIG. 2 is a perspective view of the anchoring system of FIG. 1 showing Roxul® insulation set within the channel anchor compartment.
Figure 3:
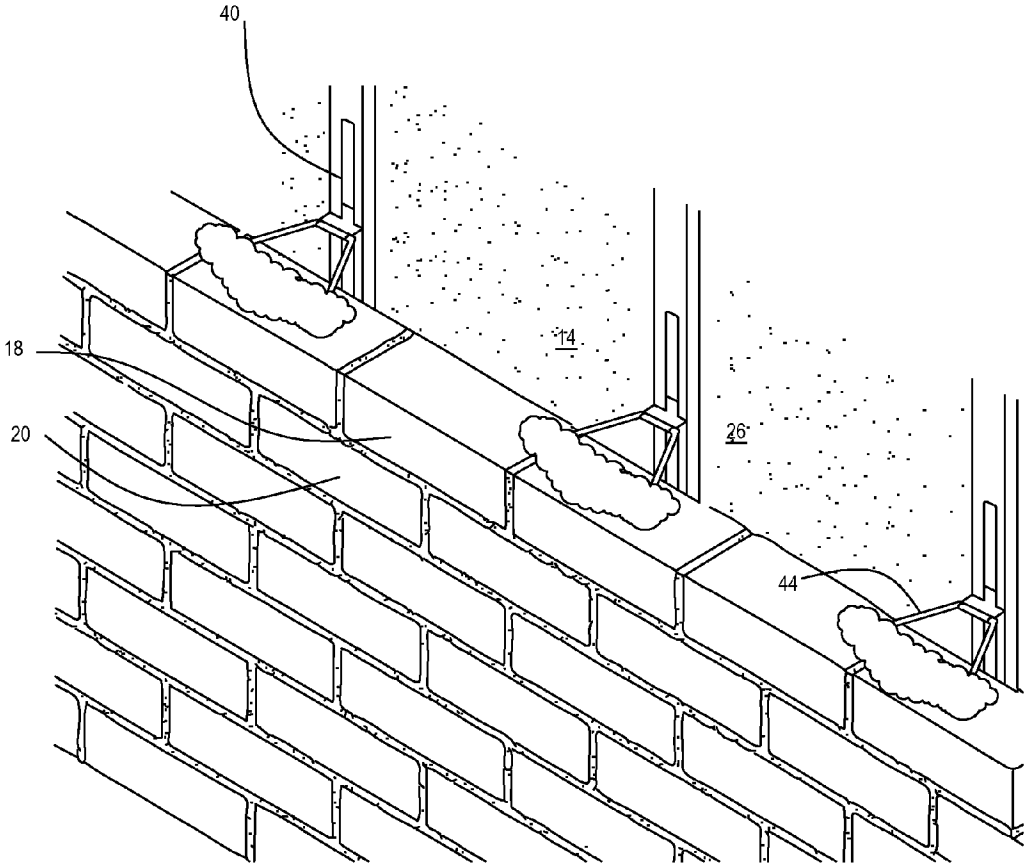
FIG. 3 is a perspective view of the anchoring system of FIG. 1 showing a fully constructed backup wall with the channel anchoring system affixed thereon with Roxul® insulation set within the channel anchor compartment and veneer ties inserted within the channels and secured within the masonry veneer.
Figure 4:
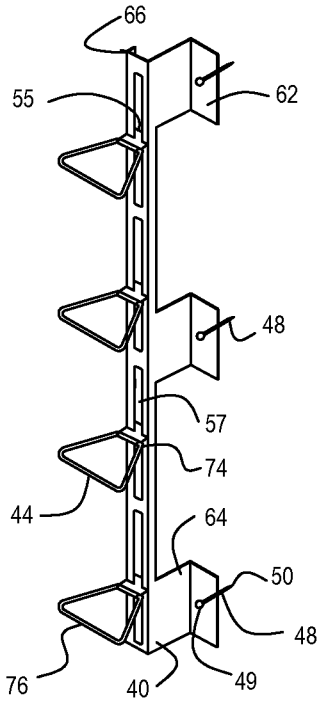
FIG. 4 is a perspective view of the anchoring system of FIG. 1 having veneer ties set within the channel.
Figure 5:
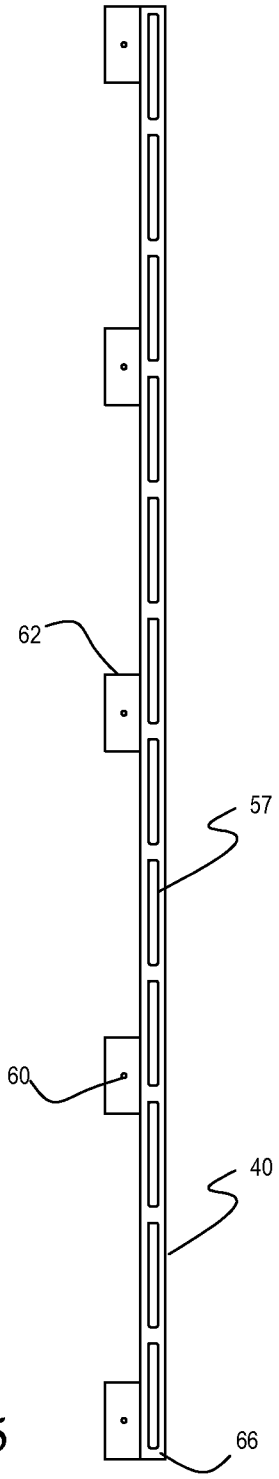
FIG. 5 is a front view of an alternative channel anchor.
Figure 6:
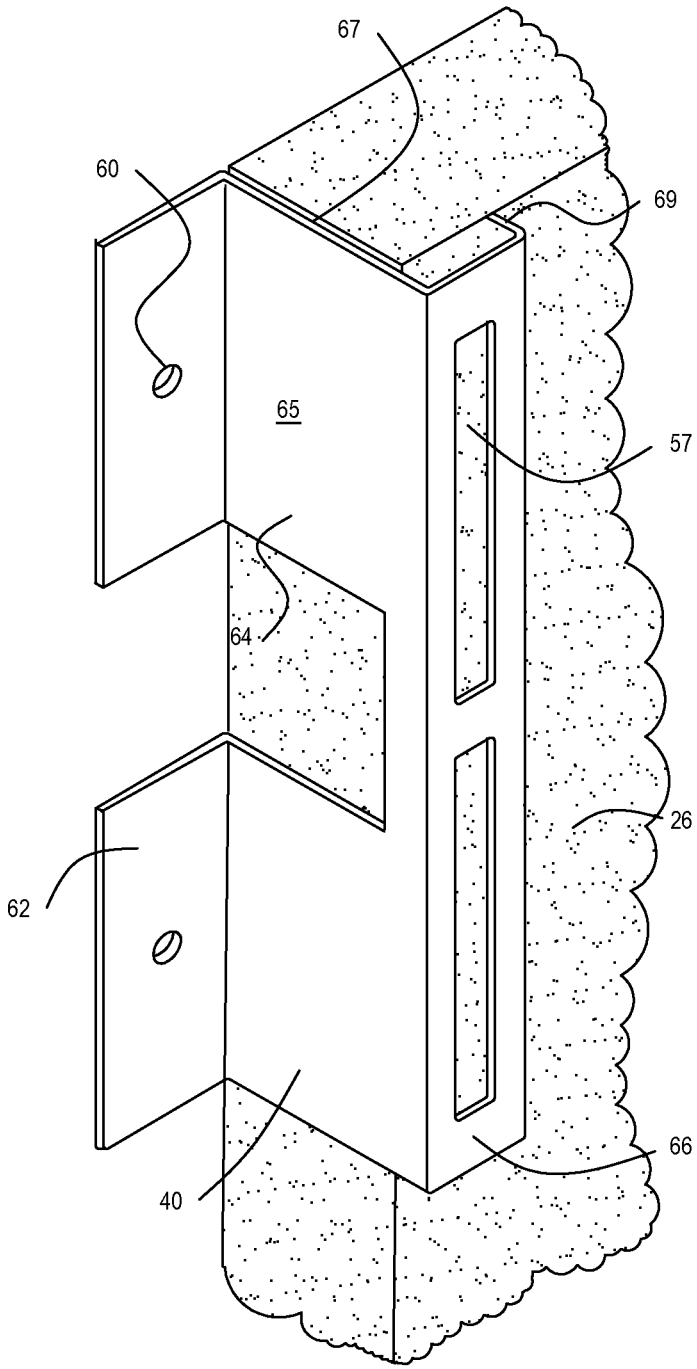
FIG. 6 is a perspective view of an alternative channel anchor with Roxul® insulation set within the channel compartment.
Figure 9:
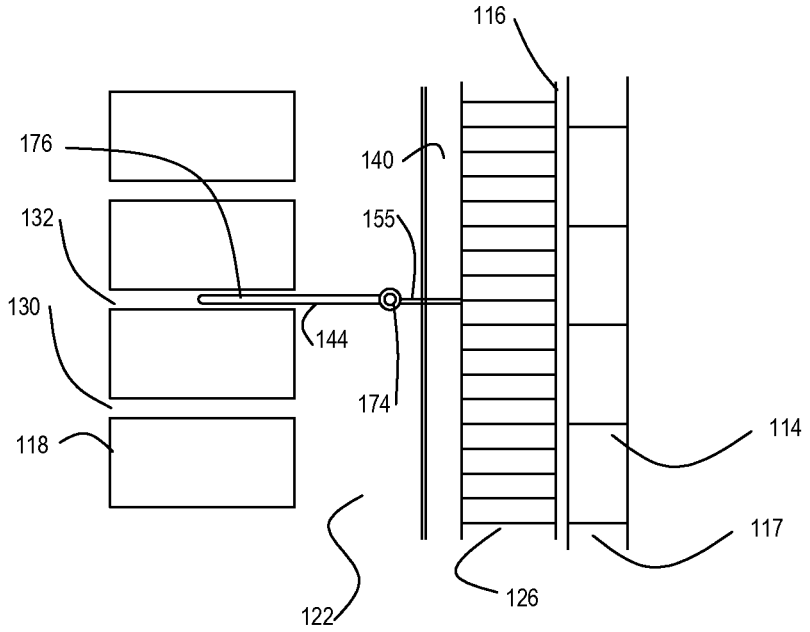

The veneer tie 44 is a wire formative. The veneer tie 44 includes an interconnecting portion 74 encased within a buckle portion 55 and is adjustably mounted within the elongated slots 57 of the channel anchor 40. The veneer tie 44 insertion portion 76 is shown in FIGS. 1 and 2 as being emplaced on a course of bricks 20 in preparation for embedment in the mortar of bed joint 32. In this embodiment, the system is not shown with a wire or outer wythe reinforcement, however, the veneer tie 144 and the wire formative reinforcement 146 shown in FIG. 9 are incorporated by reference herewithin. The veneer tie 144 insertion portion 176 contains a swaged side leg 182 formed from the insertion portion 176. The reinforcement 146 is disposed in the swaged side leg 182 and disposed in the bed joint 132 of the outer wythe 118.

The channel anchor 40 includes a back plate 62 that is secured to the inner wythe 14 by a fastener 48 inserted through the back plate aperture 60. A central plate 64 interconnects the back plate 62 and the front plate 66. The back plate 62 and the front plate 66 are substantially parallel the one to the other. The front plate 66 contains elongated slots 57 for interconnection with the veneer tie 44. The central plate includes a first face 65 and a second face 67. A compartment flange 69 is substantially parallel to the central plate 64 and adjacent the front plate 66. The compartment flange 69 is set at a predetermined distance from the inner wythe 14, which distance is substantially equivalent to the depth of the insulation 26.

The channel anchor 40 includes an insulation compartment 63 that is formed from the compartment flange 69, the central plate first face 65 and the central plate second face 67. The insulation compartment 63 forms a tight fitting pocket 61 to secure the insulation 26 therewithin. When the insulation 26 is board or rigid, the insulation 26 is first seated against the first face 65 and pushed against the second face 67 of an adjacent channel anchor 40. This method of installation and use of the pocket 61, ensures a tight fit of the insulation 26 and an installation of the insulation 26 that does not tear or otherwise adversely impact the insulation integrity.

At intervals along the horizontal surface 24, wall anchors 40 are secured to the inner wythe 14 by attachment hardware or fasteners 48. The fastener 48 has a self-drilling portion 50 for insertion in the inner wythe 14 and a fastener head 49 that is contiguous with the self-drilling portion 50. The fastener head 49 has a dimension greater than the back plate aperture 60.

Figure 7:
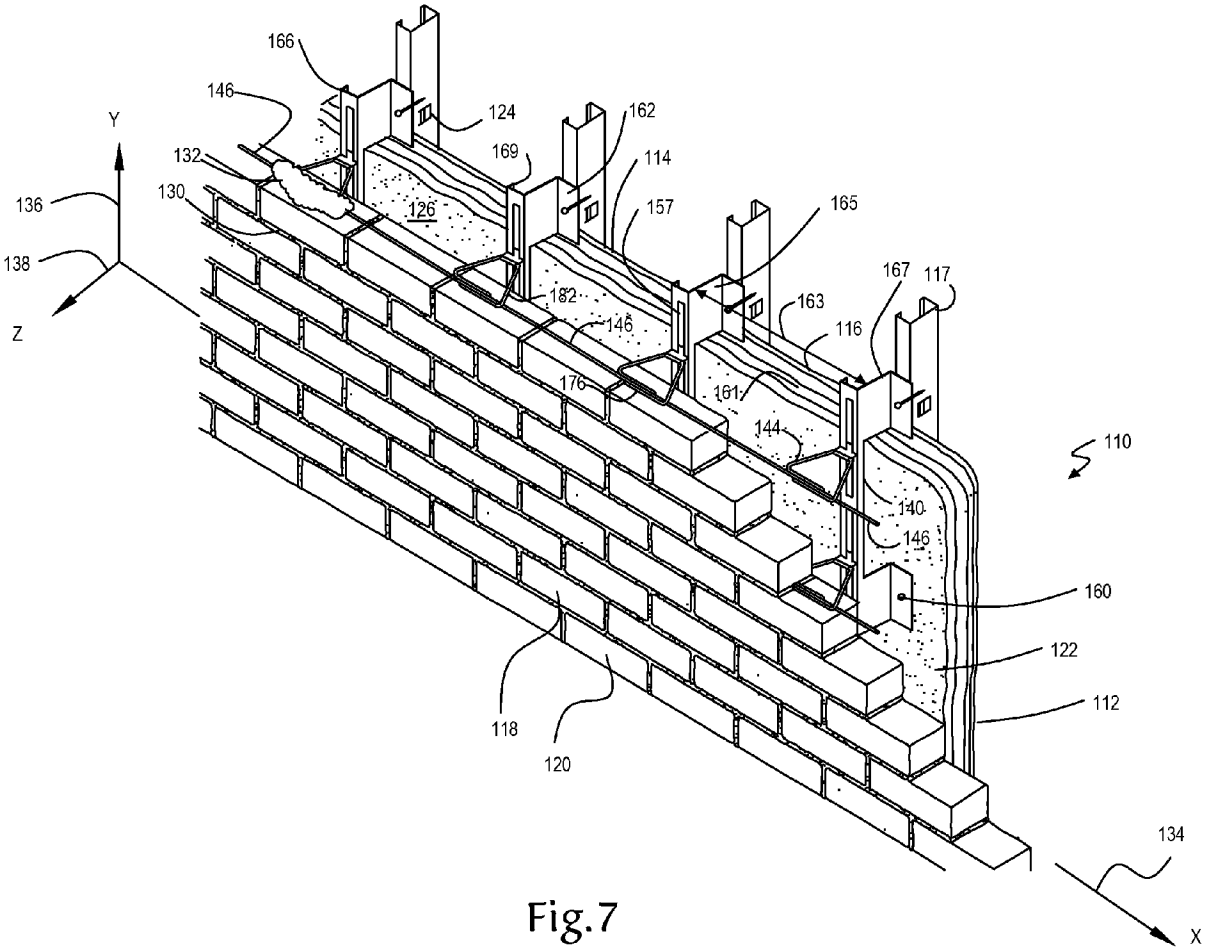
FIG. 7 is a perspective view of the second embodiment of this invention with an anchoring system having a channel anchor and veneer tie inserted therein, as applied to a structure having interior framing with insulation disposed on the framing-side thereof and within the channel anchor compartments and a veneer of brick.
Figure 8:
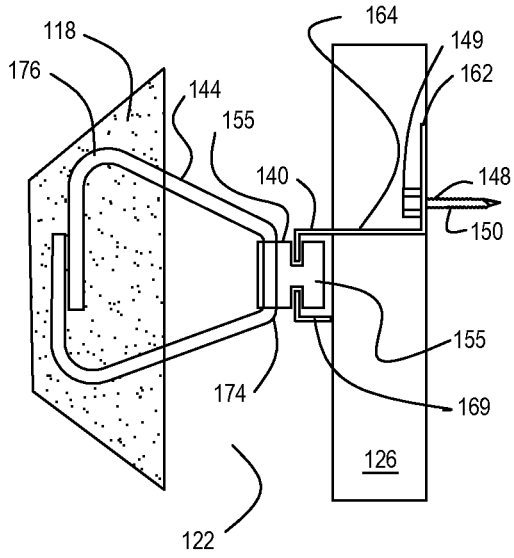
FIG. 8 is a top plan view of the anchoring system of FIG. 7 with the anchoring system secured to the backup wall with insulation secured within the channel compartment and having a veneer tie emplaced on the bed joint of the veneer; and, FIG. 9 is a cross-sectional view of the anchoring system of FIG. 7 secured to the backup wall with insulation secured within the channel compartment and having a veneer tie set within the channel and secured within the outer wythe.

The description which follows is a second embodiment of the anchoring system for insulated cavity walls of this invention. For ease of comprehension, wherever possible similar parts use reference designators 100 units higher than those above. Thus, the veneer tie 144 of the second embodiment is analogous to the veneer tie 44 of the first embodiment. Referring now to FIGS. 7 through 9, the second embodiment of the anchoring system is shown and is referred to generally by the numeral 110. As in the first embodiment, a wall structure 112 is shown. The second embodiment has an inner wythe or backup wall 114 with sheetrock or wallboard 116 mounted on metal studs or columns 117 and an outer wythe or facing wall 118 of brick 120 construction Inner wythes constructed of masonry materials or wood framing (not shown) are also applicable. Between the inner wythe 114 and the outer wythe 118, a cavity 122 is formed. The cavity 122 has attached to the exterior surface 124 of the inner wythe 114 insulation 126. The insulation 126 shown is rigid insulation commonly known as Roxul® insulation which is a rock-based mineral fiber insulation, but is applicable to other forms including board insulation, rigid insulation and spray-on insulation. Optionally, an air/vapor barrier (not shown) is included between the insulation 126 and the exterior surface 124 of the inner wythe 114.

Successive bed joints 130 and 132 are substantially planar and horizontally disposed and, in accord with current building standards, are 0.375-inch (approx.) in height. Selective ones of bed joints 130 and 132, which are formed between courses of bricks 120, are constructed to receive therewithin the insertion portion of the veneer tie 144. Being mounted on the inner wythe 114, the channel anchor or wall anchor 140 is supported thereby and, as described in greater detail herein below, is configured to secure insulation 126 and the outer wythe 118 to the inner wythe 114.

For purposes of discussion, the cavity surface 124 of the inner wythe 114 contains a horizontal line or x-axis 134 and intersecting vertical line or y-axis 136. A horizontal line or z-axis 138, normal to the xy-plane, passes through the coordinate origin formed by the intersecting x- and y-axes. A wall anchor 140, while shown as a unitary structure in FIG. 9, may be manufactured as an assemblage of several wall anchors 140 (see FIG. 6).

The veneer tie 144 is a wire formative. The veneer tie 144 includes an interconnecting portion 174 encased within a buckle portion 155 and is adjustably mounted within the elongated slots 157 of the channel anchor 140. The veneer tie 144 insertion portion 176 is shown in FIGS. 7, 8 and 9 as being emplaced on a course of bricks 120 in preparation for embedment in the mortar of bed joint 132. In this embodiment, the system is shown as a seismic system with a wire or outer wythe reinforcement 146, however, the veneer tie 44 shown in FIG. 1 is incorporated by reference herewithin as an alternative design veneer tie 44. The veneer tie 144 insertion portion 176 contains a swaged side leg 182 formed from the insertion portion 176. The reinforcement 146 is disposed in the swaged side leg 182 and disposed in the bed joint 132 of the outer wythe 118.

The channel anchor 140 includes a back plate 162 that is secured to the inner wythe 114 by a fastener 148 inserted through the back plate aperture 160. A central plate 164 interconnects the back plate 162 and the front plate 166. The back plate 162 and the front plate 166 are substantially parallel the one to the other. The front plate 166 contains elongated slots 157 for interconnection with the veneer tie 144. The central plate includes a first face 165 and a second face 167. A compartment flange 169 is substantially parallel to the central plate 164 and adjacent the front plate 166. The compartment flange 169 is set at a predetermined distance from the inner wythe 114, which distance is substantially equivalent to the depth of the insulation 126.

The channel anchor 140 includes an insulation compartment 163 that is formed from the compartment flange 169, the central plate first face 165 and the central plate second face 167. The insulation compartment 163 forms a tight fitting pocket 161 to secure the insulation 126 therewithin. When the insulation 126 is board, rigid, or semi-rigid rectangular insulation 126 the insulation 126 is first seated against the first face 165 and pushed against the second face 167 of an adjacent channel anchor 140. This method of installation and use of the pocket 161 ensures a tight fit of the insulation 126 and an installation of the insulation 126 that does not tear or otherwise adversely impact the insulation integrity.

At intervals along a horizontal surface 124, wall anchors 140 are secured to the inner wythe 114 by attachment hardware or fasteners 148. The fastener 148 has a self-drilling portion 150 for insertion in the inner wythe 114 and a fastener head 149 that is contiguous with the self-drilling portion 150. The fastener head 149 has a dimension greater than the back plate aperture 160.

In the above description of channeled anchoring systems for insulated cavity walls of this invention various configurations are described and applications thereof in corresponding settings are provided. Because varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense. Thus minor changes may be made without departing from the spirit of the invention.

What is claimed is:

1. A channel anchoring system for the interconnection of an inner wythe and an outer wythe having a cavity therebetween, for use in connection with a masonry inner wythe having insulation thereon, the anchoring system comprising:

a channel anchor mountable on the inner wythe, the channel anchor comprising:

a back plate having an aperture therethrough for receiving attachment hardware;

a front plate having elongated slots for interconnection with a veneer tie, the front plate substantially parallel to the back plate;

a central plate interconnecting the back plate and the front plate, the central plate having a first face and a second face; and, a compartment flange substantially parallel to the central plate, the compartment flange adjacent the front plate and extending in a direction toward a plane including the back plate, the compartment flange being adapted to be set at a predetermined distance from the inner wythe.

2. The anchoring system of claim 1 wherein the channel anchor further comprises an insulation compartment portion formed from the compartment flange and the central plate, the insulation compartment portion configured to form a tight fitting pocket for the securement of the insulation therewithin.

3. The anchoring system of claim 2 in combination with attachment hardware comprising a fastener having a self-drilling portion for insertion within the inner wythe and a fastener head contiguous with the self-drilling portion with a dimension greater than the back plate aperture.

4. The anchoring system of claim 1, in combination with a veneer tie configured to be adjustably mounted within the elongated slots of the front plate.

5. The anchoring system of claim 4, wherein the outer wythe has a plurality of courses of masonry units with bed joints therebetween, and wherein the veneer tie further comprises:

a buckle portion for keyed interlocking within the elongated slots;

an interconnecting portion encased within the buckle portion; and, an insertion portion contiguous with the interconnecting portion for insertion within the bed joint of the outer wythe.

6. The anchoring system of claim 5, wherein the veneer tie further comprises:

a swaged side leg formed from the insertion portion; and, a reinforcement wire disposed in the swaged side leg and configured for disposition in the bed joint of the outer wythe.

7. The anchoring system of claim 1, wherein the channel anchor comprises a plurality of back plates connected to the front plate in spaced relation, each of the plurality of back plates having an aperture therethrough for receiving attachment hardware.

8. The anchoring system of claim 1, wherein the back plate extends from the first face of the central plate in a direction away from the second face of the central plate, and the front plate extends from the second face of the central plate in a direction away from the first face of the central plate.

9. The anchoring system of claim 1, wherein the back plate is planar and configured to lie flat against the inner wythe.

10. A channel anchoring system for the interconnection of a masonry veneer to an inner wythe of stud framing with drywall thereon, the masonry veneer and inner wythe having a cavity and insulation therebetween, the anchoring system comprising:

a channel anchor mountable on the inner wythe, the channel anchor comprising:

a back plate having an aperture therethrough for receiving a fastener to attach the channel anchor to the inner wythe, the back plate being planar and configured to lie flat against the inner wythe;

a front plate having elongated slots for interconnection with a veneer tie, the front plate substantially parallel to the back plate;

a central plate interconnecting the back plate and the front plate, the central plate having a first face and a second face; and, a compartment flange substantially parallel to the central plate and adjacent the front plate, the compartment flange being adapted to be set at a predetermined distance from the inner wythe substantially coextensive with the depth of the insulation.

11. The anchoring system of claim 10 wherein the channel anchor further comprises an insulation pocket portion formed by the compartment flange, and the central plate, the insulation pocket portion configured to form a tight fitting pocket for the securement of the insulation therewithin.

12. The anchoring system of claim 11 in combination with a fastener for attaching the channel anchor to the stud framing, wherein the fastener comprises a self-drilling portion for insertion within the stud framing and a fastener head contiguous with the drilling portion with a dimension greater than the back plate aperture.

13. The anchoring system of claim 10, in combination with a veneer tie configured to be adjustably mounted within the elongated slots of the front plate.

14. The anchoring system of claim 13, wherein the masonry veneer has a plurality of courses of masonry units with bed joints therebetween, and wherein the veneer tie further comprises:

a buckle portion for keyed interlocking within the elongated slots;

an interconnecting portion encased within the buckle portion; and, an insertion portion contiguous with the interconnecting portion for insertion within the bed joint of the masonry veneer.

15. The anchoring system of claim 14, wherein the veneer tie further comprises:

a swaged side leg formed from the insertion portion; and, a reinforcement wire disposed in the swaged side leg and configured for disposition in the bed joint of the masonry veneer.

16. A channel anchoring system for the interconnection of an inner wythe and an outer wythe having a cavity therebetween, for use in connection with a masonry inner wythe having insulation thereon, the anchoring system comprising:

a channel anchor mountable on the inner wythe, the channel anchor comprising:

a back plate having an aperture therethrough for receiving a fastener;

a front plate having elongated slots for interconnection with a veneer tie, the front plate substantially parallel to the back plate;

a central plate interconnecting the back plate and the front plate, the central plate having a first face and a second face;

a compartment flange substantially parallel to the central plate, the compartment flange adjacent the front plate, the compartment flange being adapted to be set at a predetermined distance from the inner wythe substantially coextensive with the depth of the insulation; and, an insulation compartment portion formed from the compartment flange and the central plate, the insulation compartment portion configured to form a tight fitting pocket for the securement of the insulation therewithin.

17. The anchoring system of claim 16 in combination with a fastener for attaching the channel anchor to the inner wythe, wherein the fastener comprises:

a self-drilling portion for insertion within the inner wythe; and, a fastener head contiguous with the self-drilling portion, the fastener head having a dimension greater than the back plate aperture.

18. The anchoring system of claim 16, in combination with a veneer tie configured to be adjustably mounted within the elongated slots of the front plate.

19. The anchoring system of claim 18, wherein the outer wythe has a plurality of courses of masonry units with bed joints therebetween, and wherein the veneer tie further comprises:

a buckle portion for keyed interlocking within the elongated slots;

an interconnecting portion encased within the buckle portion; and, an insertion portion contiguous with the interconnecting portion for insertion within the bed joint of the outer wythe.

20. The anchoring system of claim 19, wherein the veneer tie further comprises:

a swaged side leg formed from the insertion portion; and, a reinforcement wire disposed in the swaged side leg and configured for disposition in the bed joint of the outer wythe.

* * * * *